US007717677B1

(12) United States Patent
Liang

(10) Patent No.: US 7,717,677 B1
(45) Date of Patent: May 18, 2010

(54) MULTI-METERING AND DIFFUSION TRANSPIRATION COOLED AIRFOIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 752 days.

(21) Appl. No.: 11/700,798

(22) Filed: Jan. 31, 2007

(51) Int. Cl.
*F04D 29/58* (2006.01)

(52) U.S. Cl. ..... 416/97 A; 415/115; 415/116

(58) Field of Classification Search ..... 415/115, 415/116, 96 R, 97 R, 97 A
See application file for complete search history.

(56) References Cited

U.S. PATENT DOCUMENTS 3,770,487 A * 11/1973 Gibson et al. ..... 376/414
4,743,462 A 5/1988 Radzavich et al.
5,195,243 A 3/1993 Junod
5,249,357 A 10/1993 Holmes et al.
5,498,133 A 3/1996 Lee
5,690,473 A 11/1997 Kercher
5,981,088 A 11/1999 Bruce et al.
6,004,620 A 12/1999 Camm
6,214,248 B1 4/2001 Browning et al.
6,321,449 B2 11/2001 Zhao et al.
6,375,425 B1 4/2002 Lee et al.
6,379,118 B2 4/2002 Lutum et al.
6,427,327 B1 8/2002 Bunker
6,511,762 B1 1/2003 Lee et al.
6,617,003 B1 9/2003 Lee et al.

* cited by examiner

*Primary Examiner*—Edward Look
*Assistant Examiner*—Dwayne J White
(74) *Attorney, Agent, or Firm*—John Ryznic

(57) ABSTRACT

A turbine airfoil, or a substrate exposed to a high temperature environment, having a plurality of individual cooling circuits in the airfoil wall, each individual cooling circuit having a first metering hole connecting the cooling circuit to a cooling air supply, a first diffusion cavity, a second metering hole, and a plurality of fine film cooling holes connected between the second diffusion cavity and the surface of a high temperature resistant coating. The coating is a refractory coating to provide higher heat resistance than a ceramic based thermal barrier coating. A process of forming the individual cooling circuits is also disclosed, where a ceramic core representing the above described cooling passages is secured in a "fish bowl" shaped cavity in the substrate wall, the refractory coating is applied to just under the core fingers, and the ceramic core is leached out to leave behind the cooling circuit. The cooling circuit thus formed includes a first metering hole, a first diffusion cavity, a second metering hole, a second diffusion cavity, and a plurality of micro film cooling holes to provide transpiration cooling to the coating surface.

13 Claims, 2 Drawing Sheets

View A-A

MULTI-METERING AND DIFFUSION TRANSPIRATION COOLED AIRFOIL

BACKGROUND OF THE INVENTION

1. Field of the Invention

The present invention relates generally to fluid reaction surfaces, and more specifically to a turbine airfoil with film cooling holes.

2. Description of the Related Art Including Information Disclosed Under 37 CFR 1.97 and 1.98

A gas turbine engine includes a turbine section that has a plurality of stages of stator vanes and rotor blades reacting to a high temperature gas flow passing through the turbine to convert the chemical energy from combustion into mechanical energy by rotating the turbine shaft. The efficiency of the turbine, and therefore of the engine, can be increased by increasing the hot gas flow that enters the turbine.

To allow for higher turbine entrance temperatures, the upper stage vanes and blades are made from exotic nickel alloys that can withstand very high temperatures and have complex internal cooling air passages to provide cooling to these airfoils. A thermal barrier coating (TBC) is also applied to the airfoil surfaces exposed to the hot gas flow in order to provide further protection from the heat. A TBC is typically made from a ceramic material. Also, the TBC is typically applied after the film cooling holes have been drilled into the airfoil surface to provide for the film cooling. These film cooling holes are limited to the diameter because of the drilling process.

Thicker TBC layers have been proposed to provide more protection to the airfoil substrate from the high temperature gas flow. As the TBC gets thicker, the thermal stresses developed in the TBC will tend to cause spalling.

It is therefore an object of the present invention to provide for an improved high temperature resistance coating applied to a turbine airfoil.

It is another object of the present invention to provide for a high temperature resistant coating with smaller diameter film cooling holes.

It is still another object of the present invention to provide for a process of forming small film cooling holes in a high temperature resistant coating on a turbine airfoil.

BRIEF SUMMARY OF THE INVENTION

The present invention is a turbine airfoil with a new spar airfoil cooling construction that utilizes a multi-metering diffusion compartmental cooling apparatus in conjunction with a transpiration cooling process and a thermal sprayed refractory protective coating to achieve a cooled wall for the external protective coating layer. The airfoil wall includes a plurality of diffusion chambers opening onto the outer wall surface and having cooling air supply passages opening onto the back surface. A ceramic material core having the shape of fine cooling air passages is placed in the diffusion chamber and a refractory material such as iridium or rhodium is sprayed over the airfoil to form the high temperature resistant coating. The ceramic core is then leached out, leaving in its place the fine film cooling holes. The combination of the cooling and construction process greatly reduces the airfoil coating and backing metal substrate temperature and improves the durability of the coating layer which provides for a reduction of cooling flow to improve the turbine stage performance and prolong the airfoil life.

In the prior art, thin refractory material is used in the turbine airfoil cooling design to provide protection for the airfoil and therefore reduce the cooling flow consumption and improve the turbine efficiency. As the turbine inlet temperature increases, the cooling flow demand for cooling the airfoil will increase and thus reduce the turbine efficiency. One prior art process for reducing the cooling air consumption while increasing the turbine inlet temperature for higher turbine efficiency is by using thicker coating on the airfoil external surface. At the same time, the cooling design becomes more reliant on the coating's endurance and the coating becomes the "prime reliance" in the cooling design. The disadvantages, associated with this approach is that the thicker the coating, the higher will be the coating surface temperature. Therefore cooling through the coating for the reduction of the external heat load onto the airfoil and special cooling flow management methods and mechanical attachment treatment for the thick coating is required.

DETAILED DESCRIPTION OF THE INVENTION

The present invention is a turbine airfoil, such as a stator vane or a rotor blade, used in a gas turbine engine in which the airfoil requires film cooling and a high temperature resistant coating to protect the airfoil from the high temperature gas flow. However, the invention is not limited to turbine airfoils. The invention could apply to any substrate material that uses a high temperature resistant coating to provide additional protection to the metal substrate. For example, the combustor liner of a gas turbine engine could also use this invention. Also, other high temperature resistant substrates that are used in an apparatus other than a gas turbine engine.

Figure 1:
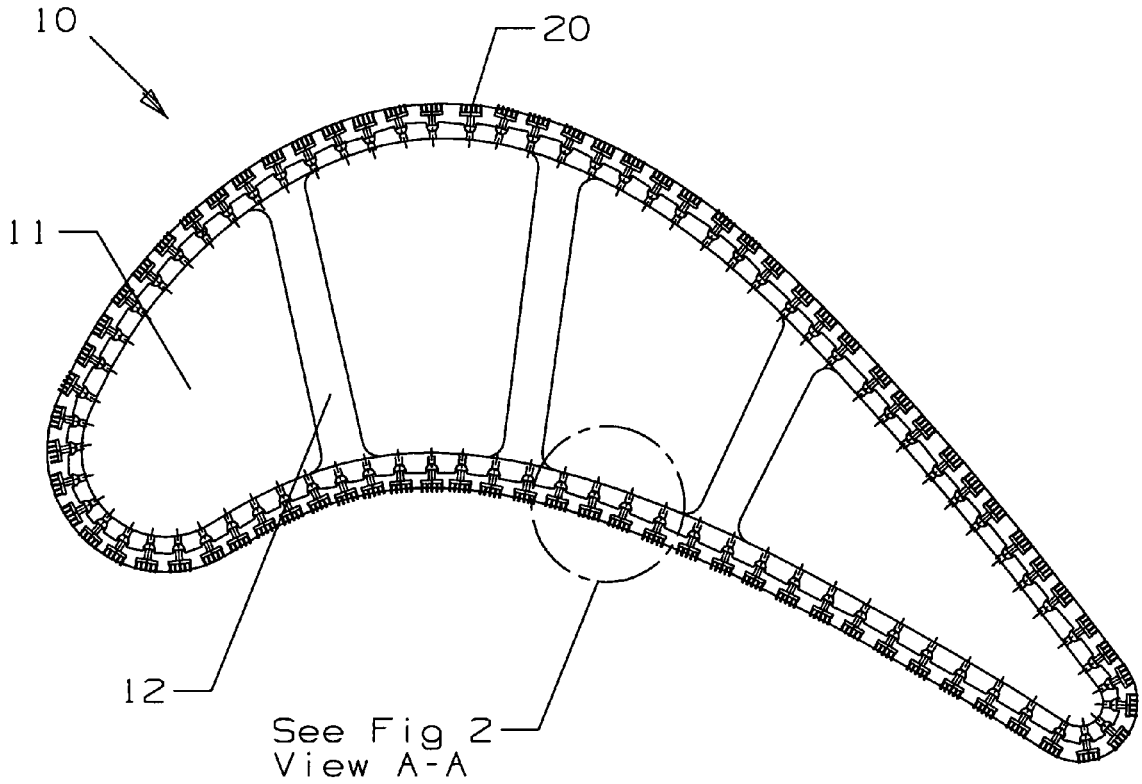
FIG. 1 shows a cross sectional view of the multi-compartmented transpiration cooled airfoil of the present invention.
Figure 2:
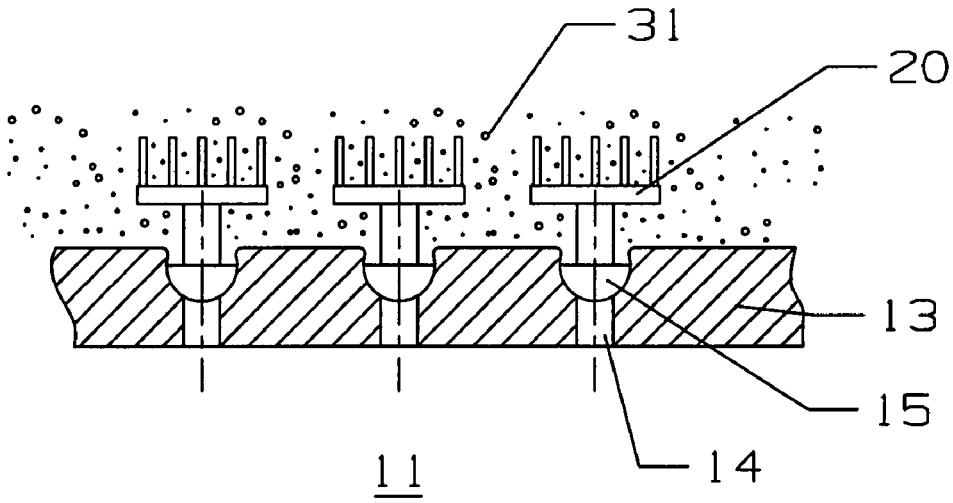
FIG. 2 shows a close-up view of a cross section of three ceramic cores placed within the diffusion chambers of the airfoil wall of the present invention.

The airfoil 10 of the present invention is shown in FIG. 1 in which a plurality of cooling supply compartments or channels 11 are formed by the airfoil walls and ribs 12 extending from the pressure side wall to the suction side wall. Four compartments 11 are shown in FIG. 1. However, more or less than four compartments can be used with the present invention. The airfoil walls include a plurality of film cooling holes 20 spaced around the airfoil to provide film cooling to a thermal resistant coating or layer that is applied over the airfoil walls. FIG. 2 shows a more detailed view of these film cooling holes.

In FIG. 2, the airfoil wall includes an inner surface facing the cooling air supply compartment 11 and an outer surface on which a high temperature resistant coating 31 is applied. The airfoil wall includes a number of diffusion chambers that are connected to a metering hole 14. The metering hole 14 is connected to the cooling air supply compartment 11. The cavity formed in the airfoil wall has a "fish bowl" shape with a wide bowl portion below the top surface and a narrower throat portion connecting the bowl to the airfoil surface at the opening. The metering hole 14 connects the cooling air supply compartment 11 to the "fish bowl" cavity or compartment. A ceramic core 20 is placed within the diffusion chamber and sticks out from the chamber as shown in FIG. 2. The "fish bowl" compartment functions like a dove-tail slot to hold the ceramic core 20 within the cavity that forms the diffusion chamber 15.

Figure 3:
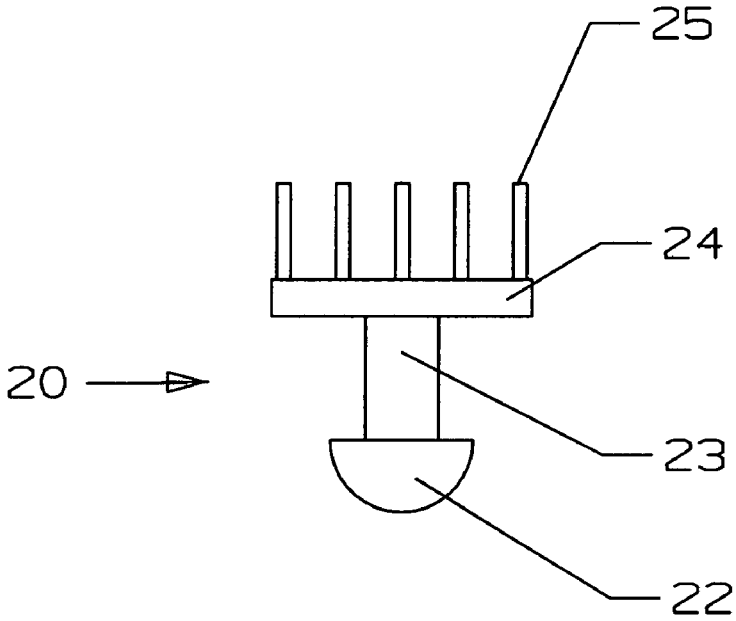
FIG. 3 shows a detailed view of one of the ceramic cores used to form the fine film cooling holes in the airfoil coating of the present invention.

The ceramic core 20 is shown in detail in FIG. 3 and includes a first diffusion portion 22, a second metering portion 23, a second diffusion portion 24, and a plurality of multiple film holes extending out from the second diffusion portion 24. The size of these film holes can be in the range of 0.005 inches to 0.01 inches which is beyond the manufacturing capability by means of drilling. The number of film holes extending out can vary depending upon how many fine film cooling holes are to be supplied by the first metering hole 14.

Referring to FIG. 2, a plurality of the ceramic cores 20 are placed within the diffusion chambers formed in the airfoil spar or wall. A refractory material such as a composition that includes Iridium and Rhodium is sprayed onto the airfoil surface with the ceramic cores held in place to form the refractory coating 31. One reason why a refractory coating is used instead of a ceramic TBC is that the refractory material may not leach out when the ceramic core 20 that forms the multiple film cooling holes is leached out. If a ceramic TBC was applied, the ceramic core 20 and most of the TBC around the ceramic core may break down. The coating is applied such that the film holes 25 stick out through the surface of the finished coating 31. After the coating 31 is applied, the ceramic core material is leached out from the airfoil wall, leaving the cooling air passages and fine film holes formed within the coating 31. The ceramic cores 20 are made from a similar ceramic material as the core ties used to form the internal cooling passages within the turbine airfoils. And, the ceramic leaching process to form the cooling passages is the same as the leaching process in the present invention that is used to form the cooling passages and fine film cooling holes in the coating 31.

The present invention is a turbine airfoil a multi-compartment with multi-metering and diffusion plus transpiration cooling circuit in a spar airfoil for a highly cooled and thick coating. The multi-metering and diffusion plus transpiration cooling apparatus are constructed in small individual modules spaced along the airfoil spar or wall. Individual modules are designed based on airfoil gas side pressure distribution in both chordwise and spanwise directions. In addition, each of the individual modules can be designed based on the airfoil local external heat load to achieve a desired local coating surface temperature. The individual modules can be constructed in a staggered or an inline array for the transpiration film hole pattern along the airfoil main body wall. With the cooling construction of the present invention, the usage of cooling air for a given airfoil inlet gas temperature and pressure profile is maximized. Also, the multi-metering and diffusion cooling construction utilizes the multi-hole film cooling technique for the thick coating layer cooling as well as flow metering purpose and the spent cooling air discharges onto the airfoil surface forming a multi-hole film cooling array at very high film effectiveness levels. The combination effects of multi-hole film cooling plus the multi-metering and diffusion cooling flow yields a very high cooling effectiveness and a uniform wall temperature for the airfoil wall.

The airfoil spar comprises several internal cooling supply channels 11. Each individual cooling air supply channel 11 is designed at different cooling air pressure and flow rates for tailoring the airfoil external local pressure and heat load requirements. In addition, a multiple grooved structure is cast onto the spar airfoil substrate. First metering holes located in the metal substrate can be machined into the grooved structure. The metering holes can be at the same pattern as the individual transpiration film cooling modules. Mini cores made of ceramic material with second multi-metering holes and diffusion chambers are then attached into the grooved structure on the spar airfoil substrate. Refractory coating is then thermally sprayed onto the attached individual modules. The ceramic core is then leached out from the thick coating layer, leaving the cooling air passages formed in the coating.

As a result of the process of the present invention, a transpiration cooled turbine airfoil with built in transpiration film cooling holes and multi-metering and diffusion cooling for a thick coating layer on a spar substrate is formed. Sizes for the transpiration film cooling holes are in the range of about 0.005 to 0.01 inches which is beyond the current manufacturing capability for drilled holes. Also, drilling a large number of film cooling holes into the thick coating layer will cause spallation of the coating material.

The multi-compartment multi-metering and diffusion cooling holes of the present invention utilizes the multi-hole cooling technique for backside convective cooling as well as flow metering purpose. The cooling air is metered and diffused twice in each individual cooling module. Thus, diffusion cavities at various size can be used in the grooved structure to diffuse the cooling air by slowing the velocity of the cooling air and dropping the cooling side pressure before discharging the cooling air onto the thick coating layer. The additional metering and diffusion cooling arrangement allows for cooling air discharge onto the mainstream through multi-holes and produces a protective film layer for the airfoil. Since the cooling air within the thick coating is reduced in momentum, coolant penetration into the gas path is minimized, yielding good buildup of the coolant sub-boundary layer next to the airfoil surface and a better film coverage in the chordwise and spanwise directions for the airfoil. The combination affects of multi-metering and diffusion plus multi-hole near surface cooling film cooling at very high film coverage yields a very high cooling effectiveness and a uniform wall temperature for the entire airfoil.

In operation, the cooling air is supplied to each individual cooling flow channel as design flow rate and pressure level. Cooling air then flows through the first metering holes within the airfoil spar wall and then is diffused into the first diffusion cavity within the grooved structure. The amount of cooling air for each individual compartment is sized based on the local gas side heat load and discharge pressure, which therefore regulates local cooling performance and metal temperature. The cooling air sir then further metered through the second metering hole which is built into the thick coating layer, impinging onto the backside of the outer coating wall first and then diffusing into the second diffusion chamber formed within the coating layer. This cooling air is then bled off from the second diffusion chamber through the multi-film cooling holes which are also formed within the thick coating layer and discharged onto the coating surface forming a highly effective film layer.

Since the first and second multi-metering and diffusion holes are connected in series, pressure ratio and the blowing ratio across the multi-film cooling holes can be regulated by setting the cooling air pressure level in the diffusion chamber or pressure ratio across the metering holes, and thus optimizing the cooling air distribution and velocity exit from the multi-film cooling holes. With the cooling circuit of the present invention, the usage of cooling air for a given airfoil inlet gas temperature and pressure profile is maximized.

I claim the following:

1. A film cooled metal substrate, the substrate having one side exposed to a hot gas flow and an opposite side exposed to a supply of cooling air, the substrate comprising:

a high temperature resistant coating applied on the hot gas flow side of the substrate;

a diffusion cavity formed within the substrate and extending substantially parallel to the surface of the substrate on the hot gas flow side;

a plurality of film cooling holes extending from the diffusion cavity and opening onto the coating surface;

a cooling air passage connecting the diffusion cavity to the side of the substrate exposed to the supply of cooling air;

the diffusion cavity is a second diffusion cavity in which the film cooling holes are connected;

a first diffusion cavity connected to the cooling air supply through a first metering hole; and, a second metering hole connecting the first diffusion cavity to the second diffusion cavity.

2. The film cooled metal substrate of claim 1, and further comprising:

the film cooling holes have a fine diameter such that transpiration cooling occurs.

3. The film cooled metal substrate of claim 1, and further comprising:

the film cooling holes have a diameter from about 0.005 inches to about 0.01 inches.

4. The film cooled metal substrate of claim 1, and further comprising:

the high temperature resistant coating is a refractory coating.

5. The film cooled metal substrate of claim 4, and further comprising:

the refractory coating is formed substantially of Iridium or an Iridium and Rhodium alloy.

6. The film cooled metal substrate of claim 1, and further comprising:

the substrate includes a plurality of the first metering hole, first diffusion cavity, second metering hole, and plurality of film cooling holes arranged along the substrate.

7. The film cooled metal substrate of claim 1, and further comprising:

the first and second metering holes are substantially the same diameter.

8. The film cooled metal substrate of claim 1, and further comprising:

the substrate is an airfoil wall used in a gas turbine engine.

9. A process of forming film cooling holes in a high temperature resistant coating applied to a surface of a substrate, the process comprising the steps of:

forming a plurality of fish bowl like chambers in the substrate with a narrow throat opening onto the substrate surface;

forming a cooling air supply hole in the substrate connecting each chamber to the inner surface of the substrate;

securing a ceramic core having a plurality of fingers extending in a direction that would be above the coating;

applying the coating to the substrate such that the fingers just stick out above the coating; and, leaching out the ceramic core such that a plurality of film cooling holes extends from each cooling air supply hole.

10. The process of forming film cooling holes in a high temperature resistant coating of claim 9, and further comprising the step of:

forming the ceramic core fingers with a diameter such that transpiration cooling occurs.

11. The process of forming film cooling holes in a high temperature resistant coating of claim 9, and further comprising the step of:

forming the ceramic core fingers with a diameter in a range of about 0.005 inches to about 0.01 inches.

12. The process of forming film cooling holes in a high temperature resistant coating of claim 9, and further comprising the step of:

applying a refractory coating to the substrate.

13. The process of forming film cooling holes in a high temperature resistant coating of claim 12, and further comprising the step of:

applying a refractory coating of substantially Iridium or an Iridium and Rhodium composition.

* * * * *